US005588843A

United States Patent [19]

Sobhani

[11] Patent Number: 5,588,843

[45] Date of Patent: Dec. 31, 1996

[54] ROTARY ELECTRICAL CONNECTOR

[75] Inventor: Mohi Sobhani, Encino, Calif.

[73] Assignee: Hughes Aircraft Company, Los Angeles, Calif.

[21] Appl. No.: 351,914

[22] Filed: Dec. 8, 1994

[51] Int. Cl.[6] ..... H01R 39/00

[52] U.S. Cl. ..... 439/22; 439/13

[58] Field of Search ..... 439/13, 18, 19, 439/20, 21, 22, 27, 29

[56] References Cited

U.S. PATENT DOCUMENTS

| | | | |
|---|---|---|---|
| 2,625,639 | 1/1953 | Mallett et al. | 439/13 X |
| 3,059,343 | 10/1962 | Kermode | 439/13 X |
| 3,479,632 | 11/1969 | Galles | 439/21 X |
| 4,773,866 | 9/1988 | Basques | 439/22 X |
| 4,932,882 | 6/1990 | Kang | 439/22 OR |
| 5,009,604 | 4/1991 | Plocek et al. | 439/29 X |

*Primary Examiner*—P. Austin Bradley
*Assistant Examiner*—Daniel Wittels
*Attorney, Agent, or Firm*—M. E. Lachman; M. W. Sales; W. K. Denson-Low

[57] ABSTRACT

A rotary electrical connector has two planar connector members. Each of the planar connector members is positioned perpendicular to an axis of rotation and is supported in rotational facing relation to the other connector member. One of the connector members has a set of concentric tracts thereon, and the other has a corresponding set of protrusions positioned to contact the tracks. A spring forces the two connector members into contact so that electrical contact is maintained between the protrusions and the tracks as one connector member rotates relative to the other connector member. External electrical contact is made on one side to the tracks, and on the other side to the protrusions.

14 Claims, 4 Drawing Sheets

ROTARY ELECTRICAL CONNECTOR

BACKGROUND OF THE INVENTION

This invention relates to electrical connectors, and, more particular, to connectors that permit an unrestricted degree of rotary motion while maintaining electrical continuity.

Rotary electrical connectors are used in a variety of applications where one part must mechanically rotate with respect to another part while retaining an electrical connection between the two parts. Where the required extent of rotation is small, typically less than one complete revolution, hardwired electrical wire connections can be used. For larger required rotations, on the order of several revolutions, wraparound wire arrangements are available.

In other instances, the connector must permit an arbitrarily large extent of rotation. The present invention relates to a connector for this type of service. In such a connector, electrical connection must be maintained, and the mode of connection cannot hinder the rotational movement. For these applications, the most common type of connector is a slip ring system. A plurality of slip rings in side-by-side arrangement extend along the length of a rotating shaft. Stationary brushes make contact to the individual slip rings. The slip ring system is operable in many situations but may have significant drawbacks. It is ordinarily expensive due to the number of parts required in the connector. Vibration in the system can lead to intermittent electrical contact. Failure usually occurs due to heat buildup resulting from reduced contact efficiency as the parts wear during service, or a surge in electrical current that causes the brushes to burn.

There is therefore a need for an improved approach to electrical connectors for applications requiring indefinitely large rotations. The present invention fulfills this need, and further provides related advantages.

SUMMARY OF THE INVENTION

The present invention provides a rotary electrical connector for service in applications requiring an unrestricted, arbitrarily large degree of rotation in both directions. The connector of the invention is more readily and inexpensively constructed than conventional connectors of this type. It has fewer parts, the most intricate of which can be fabricated using multicontact manufacturing techniques. The connector can be used in a wide variety of environments. It is self adjusting when continuing wear is experienced, reducing the likelihood of failure of a contact due to wear. A high density of contacts and connections may be in a made small space, as compared with alternative approaches. Redundancy may be built into the connector system as needed, due to the high space-efficiency of the contacts.

In accordance with the invention, a rotary electrical connector comprises a first-side planar connector member and a second-side planar connector member in facing relation to the first-side planar connector member. Preferably, both of the connector members lie perpendicular to a rotational axis. One of the planar connector members is fixed to a bearing which permits it to rotate on a rotational axle. The other of the planar connector members is preferably stationary with respect to rotational movement. One of the connector members has a plurality of radially concentric tracks thereon. The other of the connector members has a plurality of protrusions. The tracks and protrusions are disposed such that each track contacts at least one of the protrusions when the connector members are placed into facing contact. A spring forces the two connector members into facing contact such that the tracks and the protrusions contact each other. There is a plurality of track electrical conductors, each of the track electrical conductors including a track electrical contact with at least one of the tracks, and a plurality of protrusion electrical conductors, each of the protrusion electrical conductors including a protrusion electrical contact with at least one of the protrusions. The track and protrusion electrical conductors desirably extend to external contacts.

The tracks and protrusions may be formed in a printed wiring board and a flexprint circuit, respectively, to minimize the cost of their production. The tracks and protrusions are metallic conductors, and are desirably hard-faced with a metal such as a copper-nickel-gold alloy to improve their resistance to wear. When properly supported in a facing relation, the printed wiring board and flexprint circuit serve as the connector members. One of the connector members is stationary, and the other is rotatably supported on a bearing. To hold the tracks and protrusions in contact with the desired contact pressure, a spring is provided to bias one connector member toward the other. As the rotatable connector member rotates, the protrusions follow the tracks and maintain an electrical contact under the controlled pressure. With time, the tracks and protrusions wear, or the temperature of the connector may change. The spring maintains a constant pressure at the protrusion/track contact points and thence a uniform electrical contact.

To maximize the number of protrusion/track contacts and simplify the arrangement of the electrical leads, the protrusions may be circumferentially staggered. The staggering allows a larger number of protrusions than would be geometrically possible without the staggering. It also permits the use of multiple contacts and redundancy in the electrical connector, if desired.

The present approach provides an advance in the art of rotary electrical connectors. A continuous rotation capability is achieved at a relatively low cost using readily manufactured parts. Dependable operation for extended periods has been demonstrated. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
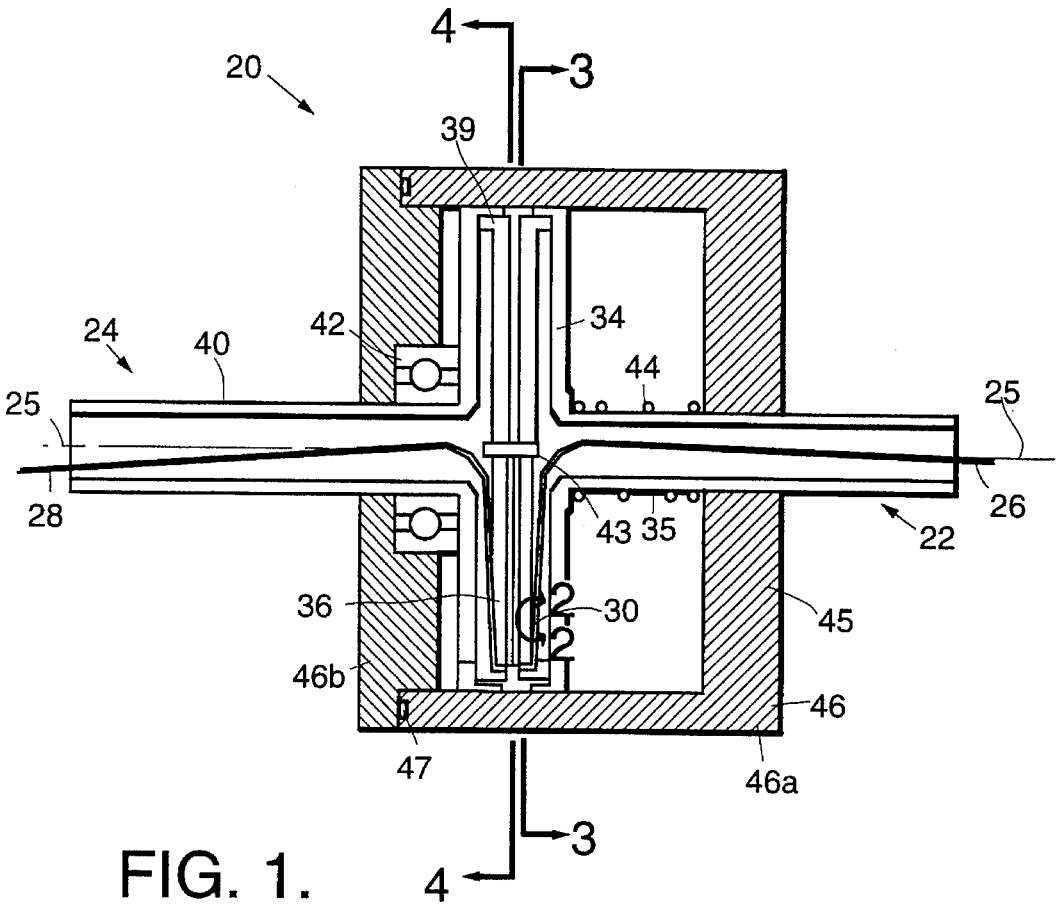
FIG. 1 is a sectional view of a rotary electrical connector.

Referring to FIGS. 1, 2*a*, 2*b*, and 2*c*, a rotary electrical connector 20 accomplishes a rotary electrical connection between a first side 22 and a second side 24 of a system. In the following preferred embodiment, the first side 22 is taken as stationary in space and the second side 24 rotates about a rotational axis 25, but the invention would be equally applicable to other configurations. A plurality of first-side electrical conductors 26 lead to the connector 20 from the first side 22, and a plurality of second-side electrical conductors 28 lead to the connector 20 from the second side 24.

A first-side connector member 30 has a first-side connector face 32 lying perpendicular to the rotational axis 25. The first-side connector member 30 is mounted to a first-side connector member base 34, which in turn is mounted to a rotationally stationary support in the form of a hollow shaft 35. A second-side connector member 36 has a second-side connector face 38 lying perpendicular to the rotational axis 25 and in facing relation to the first-side connector face 32. The second-side connector member 30 is mounted to a second-side connector member base 39, which in turn is fixed to a hollow axle 40 whose axis of rotation is coincident with the rotational axis 25. The axle 40 is supported In a bearing 42, preferably a ball-and-race type bearing, for rotational movement about the rotational axis 25. Desirably, a dowel 43 extends between the first-side connector member 30 and the second-side connector member 36, and is coincident with the rotational axis 25. The dowel 43 is preferably fixed to one of the connectors 30 or 36, and loosely received in a bore in the other of the connectors 36 or 30, respectively. The dowel 43 serves to maintain precise lateral alignment between the connector members 30 and 36 during relative rotation.

The connector members 30 and 36 are biased into facing contact. In the illustrated approach, a coil spring 44 overlies the shaft 35, with the axis of the spring 44 coincident with the rotational axis 25. The spring 44 reacts between a fixed structure, preferably the inside surface of an axially facing wall 45 of a housing 46 (to be described subsequently) and the first-side connector member base 34. The spring 44 forces the connector member 30 into a facing contact (with intervening structure to be described) against the connector member 36, the contact pressure being determined by the spring force of the spring 44.

The described components are contained within a two-part housing **46*a* and 46*b*. After the components are subassembled, the two housing parts 46*a* and 46*b* are assembled so that the connector faces 32 and 38 are in facing contact. The shaft 35 is slidably disposed to translate axially through the axially facing wall 45 of the housing 46*a*. The act of closing the housing 46 compresses the spring 44 and defines the compressive force between the connector members 30 and 36. The closure of the two parts 46*a* and 46*b* of the housing 46 may be sealed, as with an O-ring seal 47, to exclude from the interior of the housing dirt, chemicals, and other substances that could damage the connector. The electrical conductors 26 and 28 extend through the interiors of the shaft 35 and the axle 40**, respectively, which also may be sealed.

Figure 3:
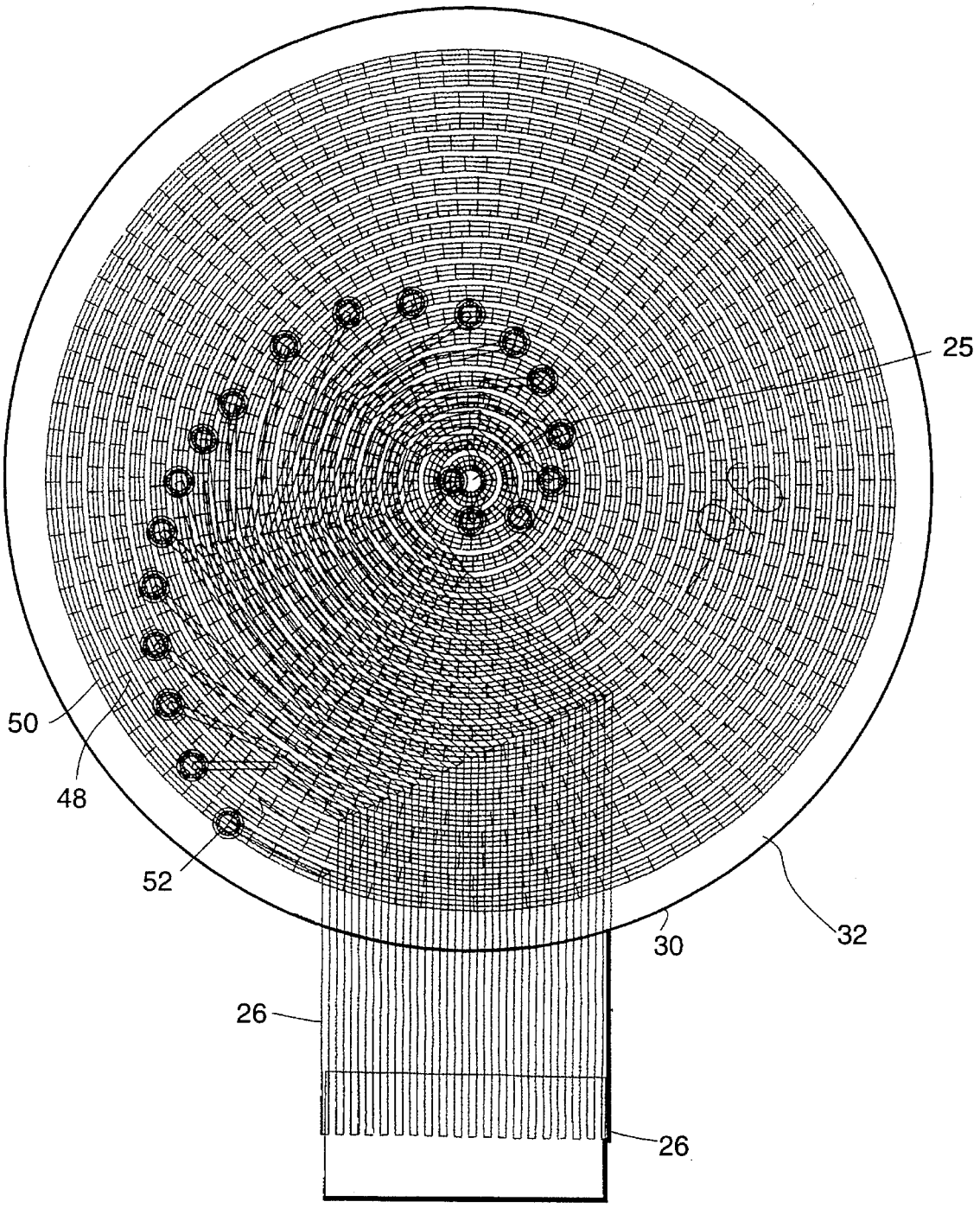
FIG. 3 is an enlarged schematic plan view of a first connector member, viewed generally on line 3—3 of FIG. 1.
Figure 4:
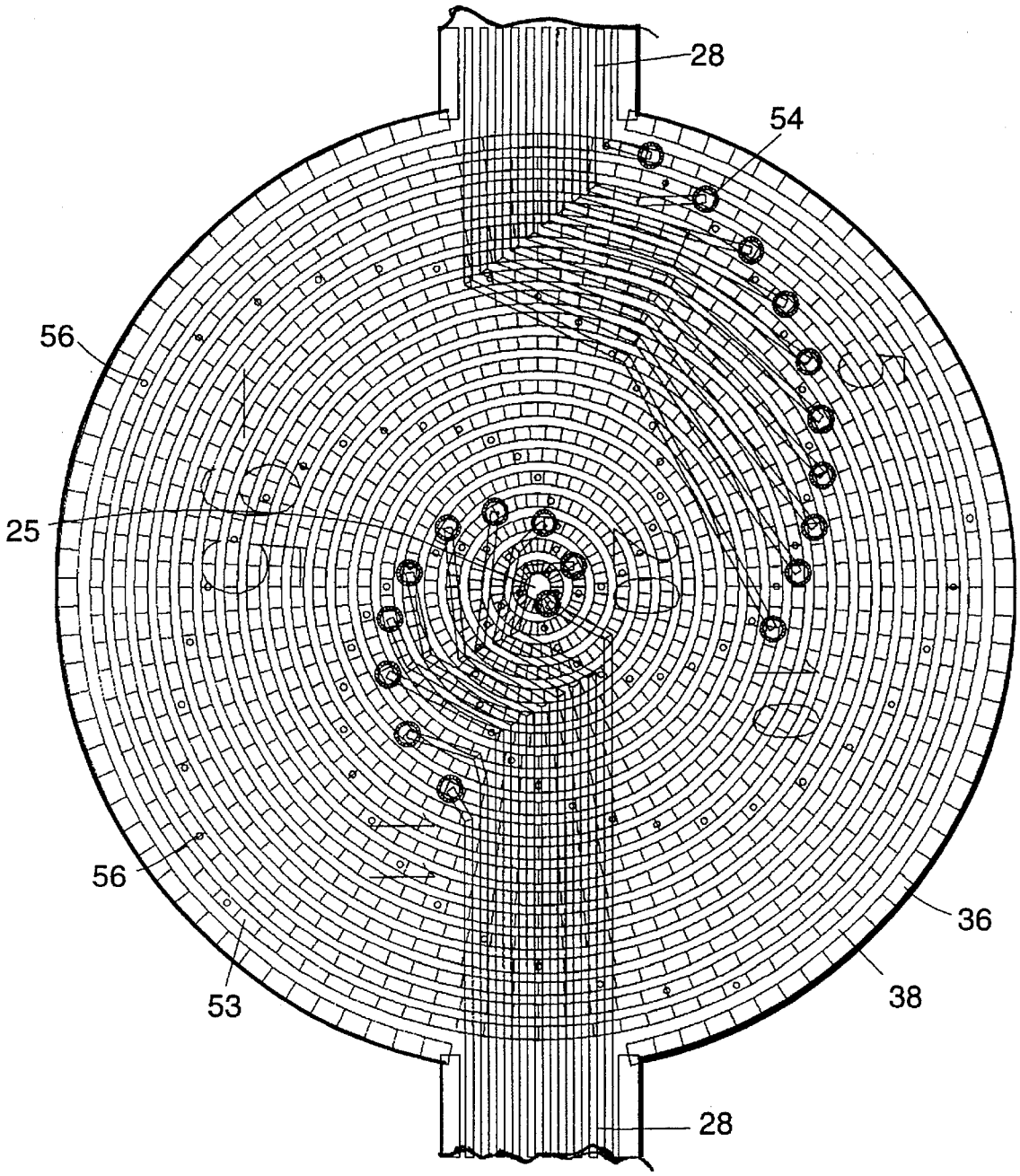
FIG. 4 is an enlarged schematic plan view of a second connector member, viewed generally on line 4—4 of FIG. 1.

FIGS. 3–4 illustrate the preferred structure of the connector faces 32 and 38 and their mode of engagement to ensure that electrical connection is continuously maintained as the connector members 30 and 36 rotate relative to each other. FIGS. 3 and 4 are schematic in that they show the structure on both the front side and the back side of each of the connector members 30 and 36, so that the relative positioning of the structural elements can be seen. As used herein, the "front side" of either of the connector members 30 or 36 is the side which faces the other of the members 36 or 30 when the connector members are assembled in facing contact. The "back side" of either of the connector members 30 and 36 is the side which faces outwardly or away from the other of the connector members 36 or 30 when the connector members are assembled.

As shown in FIG. 3, one of the connector members, here illustrated as the first-side connector member 30, has a plurality of concentric circular rings 48 thereon. The rings 48 are concentric about the rotational axis 25 and of progressively larger diameter. The rings 48 are on the back side of the first-side connector member 30. On the front side of the first-side connector member 30 is a plurality of concentric tracks 50, one track 50 aligned with each ring 48. In the embodiment of FIG. **2*a*, the tracks 50 are in the form of a groove with raised sides and a recessed center. In an alternative embodiment of FIG. 2*b*, the tracks 50 are flat. The rings 48 and the tracks 50 are made of an electrically conductive metal such as copper. The track 50** may additionally be plated or coated with a layer of a wear-resistant metal such as a known copper-nickel-gold alloy.

The first side electrical conductors 26 extend through the interior of the shaft 35. Each of the first-side electrical conductors 26 is in electrical communication with at least one of the rings 48. In the preferred approach, each conductor 26 terminates in a first-side electrical contact 52. Each contact 52 is fixed, as by wire bonding, to one of the rings 48. Electrical communication between each ring 48 and its respective track 50 is by a plated through-hole contact 58 formed of a metallic conductor that extends through the first-side connector member 30. As may be seen from FIGS. **2*a* and 3, the contact 52 need not be at the same circumferential position on the ring 48 as is the through-hole contact 58**.

As shown in FIG. 4, the other of the connector members, here illustrated as the second-side connector member 36, also has a plurality of concentric circular rings 53 thereon. The rings 53 are concentric about the rotational axis 25, and each ring 53 has a diameter that corresponds to that of a respective ring 48 on the first-side connector member 30. The rings 53 are made of an electrically conductive metal such as copper. Each of the rings 53 has at least one, and typically several, protrusions 56, extending upwardly from the front side thereof, so as to be in facing contact with the track 50 of the first-side connector member 30. Each protrusion 56 is made of an electrically conductive metal such as copper. It is also preferably plated or coated with a layer of a wear-resistant metal such as copper-nickel-gold alloy.

FIGS. **2*a* and 2*b* illustrate protrusions 56 made in the form of bumps that are formed by electroplating or other deposition technique. Alternatively, as shown in FIG. 2*c*, the protrusions 56** may be made as outwardly projecting dimples in a piece of flexprint material.

The second-side electrical conductors 28 extend through the interior of the axle 40. To establish electrical contact to the protrusions 56, each of the second-side electrical conductors 28 terminates in a second-side electrical contact 54. Each contact 54 is fixed, as by wire bonding, to a plated through-hole electrical contact 60 to the back side of one of the rings 53. The contact 54 to each ring 53 is not necessarily positioned at the same circumferential location on the ring as the protrusion 56, as shown in FIG. 4. The ring 53, contact 56, and electrical contact 60 are each made of an electrically conductive material such as copper that forms a conductive path between the protrusion 56 and the second side electrical conductor 28. Alternatively, as in the case of the flexprint circuit of FIG. **2*c*, the electrical connection to the second-side electrical conductors 28 may be made via an etched or deposited conductor path that lies out of the plane of the figure and extends to terminals to which the electrical conductors 28** are bonded.

Figure 2A:
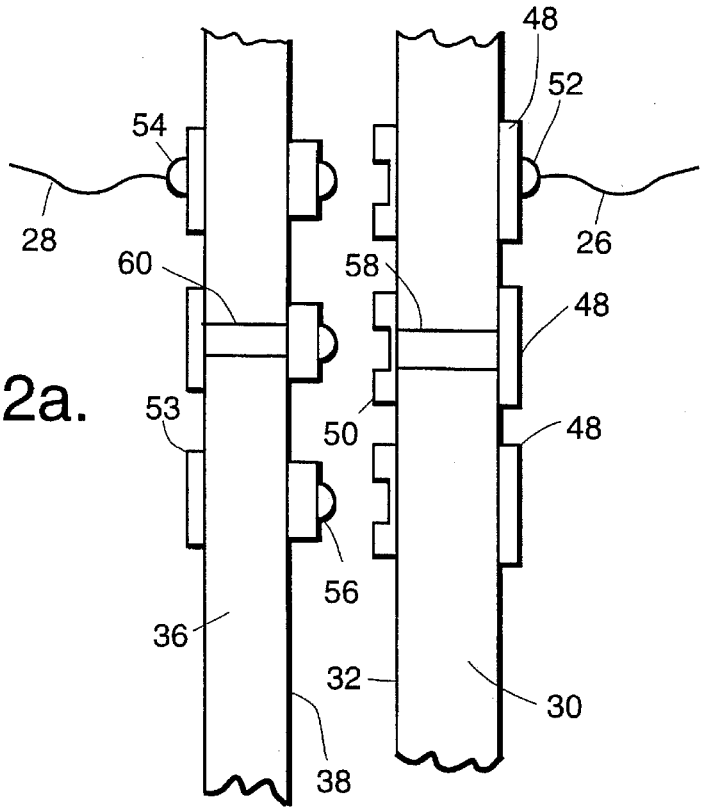
FIG. 2*a* is an enlarged detail of a first embodiment of the rotary electrical connector of FIG. 1, taken generally in region 2—2.
Figure 2B:
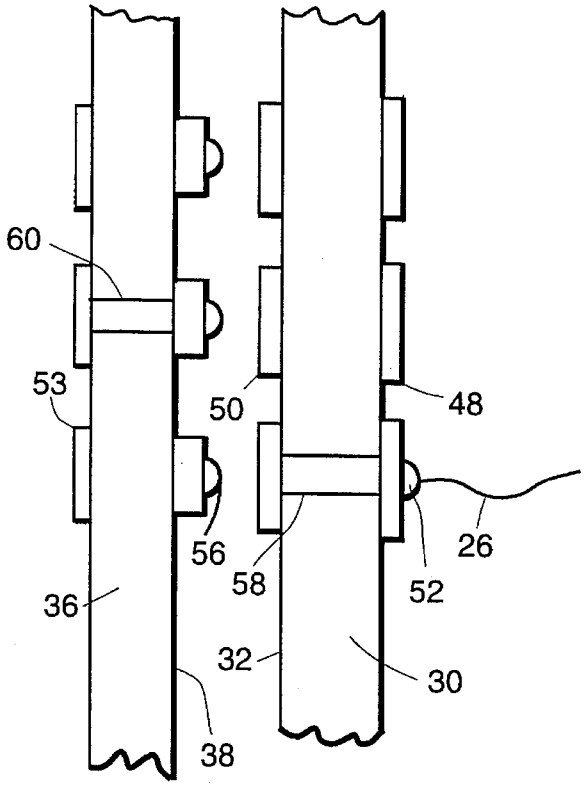
FIG. 2*b* is an enlarged detail of a second embodiment of the rotary electrical connector of FIG. 1, taken generally in region 2—2.
Figure 2C:
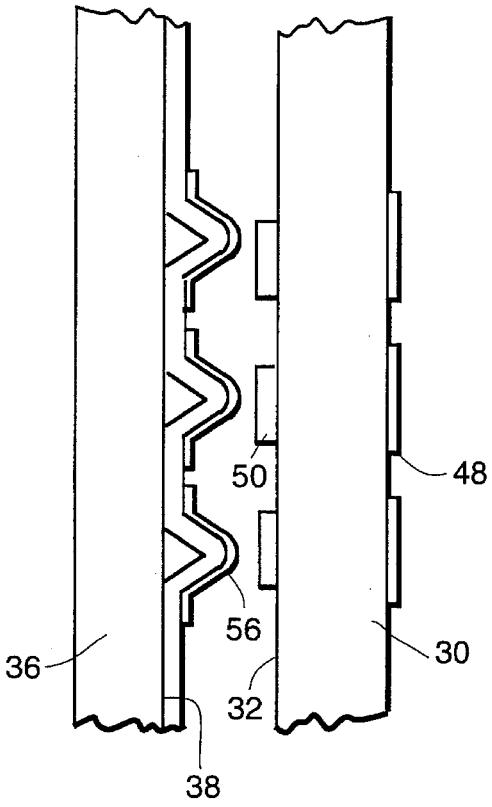
FIG. 2*c* is an enlarged detail of a third embodiment of the rotary electrical connector of FIG. 1, taken generally in region 2—2.

The protrusions 56 are positioned such that, when the connector members 30 and 36 are biased into facing contact with each other, each protrusion 56 engages one of the tracks 50 and rides in its recessed central portion (FIG. 2*a*) or on its flat face (FIG. 2*b* and FIG. 2*c*). FIGS. 2*a–c* show the pertinent structure with a slight separation in each case between the protrusion and the track for clarity of illustration, but it is apparent that, when the second-side connector member 36 is moved to the right into facing contact with the first side-connector member 30, the protrusion 56 will ride on the track 50. The rings 48 are concentric about the axis of rotation of the second-side connector member 36, so that each protrusions 56 will slide along its respective track 50 as the second-side connector member 36 rotates.

The tracks and protrusions may be viewed more generally as electrical contact engagement members. The track and protrusion structure just described is preferred, but other operable physical arrangements are also acceptable within the scope of the invention as long as the engagement is maintained during the relative rotary movement.

The protrusions 56 are preferably arranged in a circumferentially staggered manner over a range of circumferential locations relative to the rotational axis, as shown in FIG. 4. This arrangement provides room to fabricate the structure and a spacing between the contacts to avoid shorting. It is preferred to use the same type of circumferential staggering for the first-side electrical contacts 52 and the second-side electrical contacts 54, for the same reasons.

The approach of the invention allows a high density of electrical contacts and protrusions per unit face area of the connector members 30 and 36. Accordingly, the size of the housing 46 can be relatively small for the number of rotational electrical connections that are made. This high density of connections also permits the use of redundancy to further improve the reliability of the contacts. Thus, as shown in FIG. 4, more than one protrusion 56 is present for each of the rings 53. The presence of multiple protrusions 56 contacting each track 50 provides an important redundancy that improves connector performance by, for example, reducing the electrical resistance of the connector, reducing the likelihood that electrical continuity of the connector could be lost due to vibration or mechanical shock of the connector, and improving the resistance of the connector to degradation due to sliding damage, oxidation, or other progressive failure mechanism during service. The multiple protrusions could be part of the same electrical conductor, as shown in FIG. 4, or multiple conductors could lead to protrusions on multiple rings. These types of redundancy permit a structure wherein rotary electrical contact would be maintained in the event of a protrusion failure, a track failure, or failure of a contact 52 or 54.

The approach of the invention can be implemented using existing wire technologies. The first-side connector member 30 can be made as a printed wiring board (PWB) with tracks fabricated as the concentric rings described previously. The second-side connector member 36 can be made as a flexprint circuit with protrusions plated onto or dimpled upwardly from the electrical conductors. The printed wiring board and flexprint are made of polyimide or other insulator material laminated to copper foil, and are available in various thicknesses. Through-hole plated connectors provide the backside electrical contact in each case.

Eight prototype connectors, four with 9 conductors and four with 24 conductors, have been built using the approach described herein. These connectors were tested by rotation at 10 revolutions per minute for a total of about 12,000 hours. Periodically, electrically connectivity tests were performed by passing power signals of up to two amperes AC or DC through the contacts, and RS170 video signals through the contacts. No signal degradation was observed through the life of the testing.

A manufacturing cost comparison was made between the 24-conductor design of the present invention, and a conventional 24-conductor slip ring design. The 24-conductor design of the present invention has 9 parts, only two of which require precision machining, and is estimated to cost \$10–\$20 each in production quantities. The conventional 24-conductor design using slip ring contacts has 124 parts, and is estimated to cost \$80–\$500 each in production quantities.

The rotary connector of the invention thus achieves important performance, manufacturing, and cost advantages over conventional rotary connector designs. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A rotary electrical connector, comprising:

a first-side connector member comprising a printed wiring board and having a first-side connector face lying perpendicular to a rotational axis, the first-side connector face having a plurality of first-side engagement members arranged as concentric rings thereon;

a plurality of first-side electrical conductors, each of the first-side electrical conductors including a first-side electrical contact with at least one of the plurality of first-side engagement members;

a second-side connector member having a second-side connector face lying perpendicular to the rotational axis, the second-side connector face having a plurality of second-side engagement members thereon disposed such that each of the second-side engagement members contacts one of the first-side engagement members when the first-side engagement face and the second-side engagement face are placed into facing contact;

a plurality of second-side electrical conductors, each of the second-side electrical conductors including a second-side electrical contact with at least one of the plurality of second-side engagement members;

support means for positioning the first-side connector member in facing contact with the second-side connector member and for permitting the second-side connector member to rotate with respect to the first-side connector member about the rotational axis; and biasing means for biasing the first-side connector face against the second-side connector face.

2. The rotary electrical connector of claim 1, wherein each first-side engagement member comprises a track and each second-side engagement member comprises a protrusion sized to ride on the track.

3. The rotary electrical connector of claim 2, wherein the track and the protrusion each have a metallic face.

4. The rotary electrical connector of claim 1, wherein the second-side electrical contacts are staggered over a range of circumferential locations relative to the rotational axis.

5. The rotary electrical connector of claim 1, wherein the support means comprises a bearing that supports one of the first-side connector member and the second-side connector member for rotational movement about the rotational axis.

6. The rotary electrical connector of claim 1, wherein the biasing means comprises a coil spring having a coil spring axis coincident with the rotational axis.

7. The rotary electrical connector of claim 1, further comprising a housing in which the connector members are received.

8. The rotary electrical connector of claim 1, wherein the first-side planar connector member is not rotatable.

9. A rotary electrical connector, comprising:

a first-side planar connector member comprising a printed wiring board;

a second-side planar connector member disposed in facing relation to the first-side planar connector member;

a bearing to which the second-side planar connector member is fixed, the bearing permitting the second-side planar connector member to rotate on a rotational axle;

a plurality of radially concentric tracks on the first-side planar connector member;

a plurality of protrusions on the second-side planar connector member, the tracks and protrusions being disposed such that each track contacts at least one of the protrusions when the connector members are placed into facing contact;

a spring that forces the two connector members into facing contact such that the tracks and the protrusions contact each other;

a plurality of track electrical conductors, each of the track electrical conductors including a track electrical contact with at least one of the tracks; and a plurality of protrusion electrical conductors, each of the protrusion electrical conductors including a protrusion electrical contact with at least one of the protrusions.

10. The rotary electrical connector of claim 9, wherein each track and each protrusion have a metallic face.

11. The rotary electrical connector of claim 9, wherein the protrusions are staggered over a range of circumferential locations relative to the rotational axle.

12. The rotary electrical connector of claim 9, wherein the bearing comprises a ball-and-race bearing.

13. A rotary electrical connector, comprising:

a first-side connector member having a first-side connector face lying perpendicular to a rotational axis, the first-side connector face having a plurality of first-side engagement members arranged as concentric rings thereon;

a plurality of first-side electrical conductors, each of the first-side electrical conductors including a first-side electrical contact with at least one of the plurality of first-side engagement members;

a second-side connector member comprising a flexible printed circuit and having a second-side connector face lying perpendicular to the rotational axis, the second-side connector face having a plurality of second-side engagement members comprising protrusions thereon disposed such that each of the second-side engagement members contacts one of the first-side engagement members when the first-side engagement face and the second-side engagement face are placed into facing contact;

a plurality of second-side electrical conductors, each of the second-side electrical conductors including a second-side electrical contact with at least one of the plurality of second-side engagement members;

support means for positioning the first-side connector member in facing contact with the second-side connector member and for permitting the second-side connector member to rotate with respect to the first-side connector member about the rotational axis; and biasing means for biasing the first-side connector face against the second-side connector face.

14. A rotary electrical connector, comprising:

a first-side planar connector member;

a second-side planar connector member comprising a flexible printed circuit and disposed in facing relation to the first-side planar connector member;

a bearing to which the second-side planar connector member is fixed, the bearing permitting the second-side planar connector member to rotate on a rotational axle;

a plurality of radially concentric tracks on the first-side planar connector member;

a plurality of protrusions on the second-side planar connector member, the tracks and protrusions being disposed such that each track contacts at least one of the protrusions when the connector members are placed into facing contact;

a spring that forces the two connector members into facing contact such that the tracks and the protrusions contact each other;

a plurality of track electrical conductors, each of the track electrical conductors including a track electrical contact with at least one of the tracks; and a plurality of protrusion electrical conductors, each of the protrusion electrical conductors including a protrusion electrical contact with at least one of the protrusions.

* * * * *